US006807129B1

(12) United States Patent
Chan

(10) Patent No.: US 6,807,129 B1
(45) Date of Patent: Oct. 19, 2004

(54) CLOCK

(75) Inventor: Man-Yan Chan, Kowloon (CN)

(73) Assignee: Sunflower Holdings Ltd., Tortola (VG)

( * ) Notice: Subject to any disclaimer, the term of this patent is extended or adjusted under 35 U.S.C. 154(b) by 239 days.

(21) Appl. No.: 10/085,335

(22) Filed: Feb. 28, 2002

(51) Int. Cl.[7] ..... G04B 19/00; G04B 19/06

(52) U.S. Cl. ..... 368/223; 368/76; 368/228; 368/232

(58) Field of Search ..... 368/10, 76, 79, 368/95, 225, 228, 327, 232, 223, 238; D10/1, 128

(56) References Cited

U.S. PATENT DOCUMENTS

| | | | | | |
|---|---|---|---|---|---|
| 4,421,421 | A | * | 12/1983 | Bradt | 368/229 |
| 5,303,211 | A | * | 4/1994 | Yanaka et al. | 368/76 |
| 5,521,888 | A | * | 5/1996 | Fransen | 368/220 |
| 6,278,664 | B1 | * | 8/2001 | Huffman et al. | 368/223 |
| 6,421,602 | B1 | * | 7/2002 | Bullock et al. | 701/201 |

* cited by examiner

*Primary Examiner*—Randy W. Gibson
*Assistant Examiner*—Michael L. Liudinger
(74) *Attorney, Agent, or Firm*—Alix, Yale & Ristas, LLP

(57) ABSTRACT

A clock includes a support hanger, a hand-moving mechanism attached to the support hanger, a number of time indicators suspended from the support hanger, and hands attached to the hand-moving mechanism to point at the time indicators by action of the hand-moving mechanism. The clock does not have a conventional face.

8 Claims, 2 Drawing Sheets

CLOCK

BACKGROUND OF THE INVENTION

The present invention relates to clocks. More particularly, though not exclusively, the invention relates to a clock having a number of suspended elements.

Known "analog" clocks have a dial over which a number of hands sweep. The dial or face usually has hour markings at which the hands of the clock point. The face serves little or no purpose other than to display the markings. Of course, the date is sometimes shown as well, but then some sort of window has to be made through the dial or face through which the date can be seen. In other words, clock dials or faces have only limited useful surface area, namely that part which displays the hour markings, and are therefore an inefficient means of displaying those markings.

Many novelty clocks have been proposed over the years, but they all have a face or dial. The central part of many clock dials has been used to show brand names, cartoon characters and the like, but this is but a mere exploitation of otherwise wasted surface area.

OBJECTS OF THE INVENTION

It is an object of the present invention to overcome or substantially ameliorate at least one of the above disadvantages and/or more generally to provide an improved clock.

It is a further object of the present invention to provide an improved clock having no dial extending from its centre to its time indicators.

It is yet a further object of the invention to provide a novelty clock having a suspended hand-moving mechanism and time indicators suspended separately from the hand-moving mechanism.

DISCLOSURE OF THE INVENTION

There is disclosed herein a clock comprising a support, a hand-moving mechanism attached to the support, a plurality of time indicators attached to the support independently of the hand-moving mechanism, and a hand attached to the hand-moving mechanism and adapted to point to the time indicators by action of the hand-moving mechanism.

Preferably, the support is a hanger from which the hand-moving mechanism and time indicators are suspended.

Preferably, the hand-moving mechanism and time indicators are suspended from the hanger by cords.

Preferably the cords are torsionally resilient to prevent permanent twisting of the time indicators.

Preferably the hand-moving mechanism is suspended by two said cords.

Preferably one of the time indicators is suspended from the hand-moving mechanism.

Preferably the time indicators are Arabic numbers.

Preferably each time indicator has a cord connector by which it is attached to one of said cords.

Preferably some of the time indicators include two cord connectors, one positioned above the other in use, the lower one of which suspends another said time indicator with another cord.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
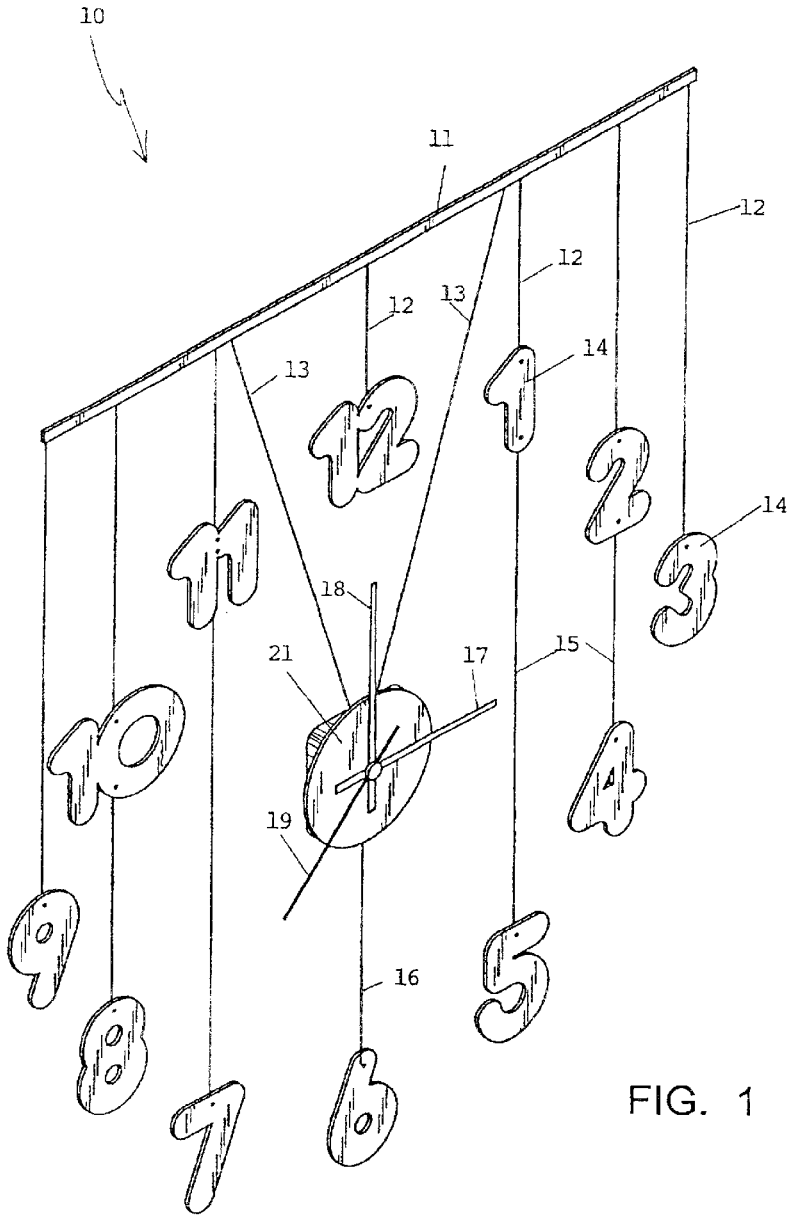
FIG. 1 is a schematic perspective view of a clock.

In FIG. 1 there is schematically depicted a clock 10. Clock 10 includes a support hanger 11 from which a number of hour indicators 14 are suspended by cords 12 (and some by additional cords 15).

At the centre of the arrangement of hour indicators is a hand-moving mechanism 21 having an hour hand 17, a minute hand 18 and a second hand 19. The hand-moving mechanism might be of the battery-operated type, or of a mechanical wind-up type. The mechanism 21 is suspended by a pair of cords 13 that form a V-shape and therefore prevent the mechanism from swinging or twisting. The other cords 12 and 15 might be inherently non-twisting (by appropriate fibre construction, or might be formed from a solid core of plastics material or metal, or other material that if twisted, returns to its original untwisted state. Alternatively, each cord might be a strap or ribbon that returns to a straight configuration if the hour indicators are turned. As a result, the hour indicators will always return to the straight-forward position as illustrated.

In the illustrated embodiment, the "6" indicator is suspended from the mechanism 21 by a similar cord.

Figure 2:
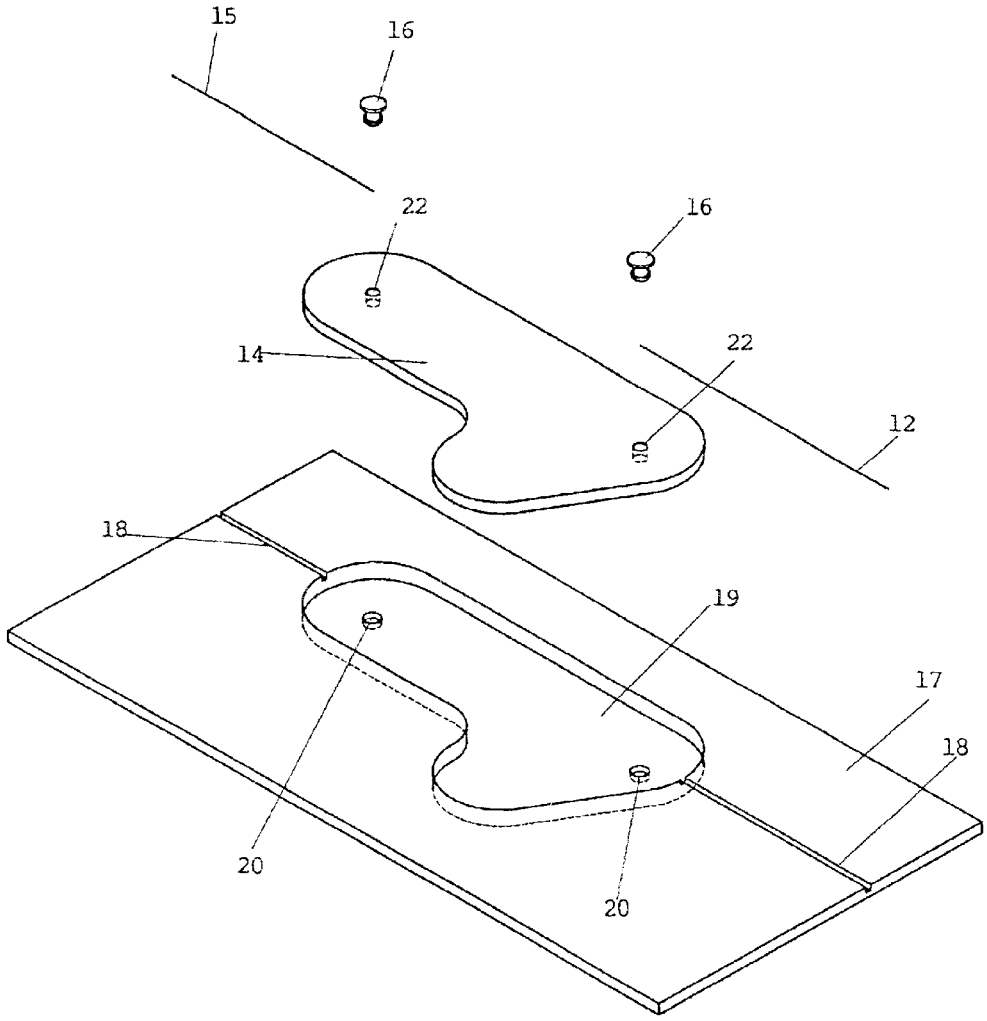
FIG. 2 is a schematic perspective view of a jig for fastening a time indicator to a pair of cords.

In order to attach the hour indicators to the cords, a jig 12 as shown in FIG. 2 can be used. The jig 12 has a recess 19 into which the hour indicator is received. There are two holes 20 aligned with the cord-securing apertures 22 of the indicator 14. There is a slot 18 at each end of the jig to receive lengths of cord 12 and 15. A pair of buttons 16 secure the cords into the respective apertures 22.

It should be appreciated that modifications and alterations obvious to those skilled in the art are not to be considered as beyond the scope of the present invention. For example, the hour indicators could be arranged in a square shape instead of the circular shape depicted. Also, instead of suspending the hour indicators from a hanger, a base could support the indicators on thin rods. As yet a further alternative, the hour indicators could be on an annular ring supported, or suspended separately with respect to the hand-moving mechanism.

What is claimed is:

1. A clock comprising a hanger, a hand-moving mechanism suspended from the hanger, a plurality of time indicators suspended from the hanger independently of the hand-moving mechanism, and a hand attached to the hand-moving mechanism and adapted to point to the time indicators by action of the hand-moving mechanism.

2. The clock of claim 1 wherein the hand-moving mechanism and time indicators are suspended from the hanger by cords.

3. The clock of claim 2 wherein the cords are torsionally resilient to prevent permanent twisting of the time indicators.

4. The clock of claim 2 wherein the hand-moving mechanism is suspended by two said cords.

5. The clock of claim 1 wherein one of the time indicators is suspended from the hand-moving mechanism.

6. The clock of claim 1 wherein the time indicators are Arabic numbers.

7. The clock of claim 2 wherein each time indicator has a cord connector by which it is attached to one of said cords.

8. The clock of claim 7 wherein some of the time indicators include two cord connectors, one positioned above the other in use, the lower one of which suspends another said time indicator with another cord.

* * * * *